US012281525B2

(12) United States Patent
McCormick

(10) Patent No.: US 12,281,525 B2
(45) Date of Patent: Apr. 22, 2025

(54) DEVICE FOR CENTERING A SENSOR ASSEMBLY IN A BORE

(71) Applicant: PETROMAC IP LIMITED, Auckland (NZ)

(72) Inventor: Stephen Peter McCormick, Auckland (NZ)

(73) Assignee: PETROMAC IP LIMITED, Auckland (NZ)

( * ) Notice: Subject to any disclaimer, the term of this patent is extended or adjusted under 35 U.S.C. 154(b) by 0 days.

(21) Appl. No.: 18/494,975

(22) Filed: Oct. 26, 2023

(65) Prior Publication Data

US 2024/0141735 A1 May 2, 2024

(30) Foreign Application Priority Data

Nov. 1, 2022 (NZ) ..... 794016

(51) Int. Cl.
*E21B 17/10* (2006.01)
*E21B 47/01* (2012.01)

(52) U.S. Cl.
CPC ..... *E21B 17/1021* (2013.01); *E21B 47/01* (2013.01)

(58) Field of Classification Search
CPC .. E21B 17/1021; E21B 47/01; E21B 17/1014; E21B 17/10
See application file for complete search history.

(56) References Cited

U.S. PATENT DOCUMENTS

| | | | | |
|---|---|---|---|---|
| 4,615,386 | A | 10/1986 | Briscoe | |
| 5,358,040 | A * | 10/1994 | Kinley | E21B 17/1021 175/325.3 |
| 10,947,792 | B1 * | 3/2021 | McCormick | E21B 47/01 |
| 10,988,991 | B1 * | 4/2021 | McCormick | E21B 17/1021 |
| 2022/0298870 | A1 | 9/2022 | McCormick et al. | |

* cited by examiner

*Primary Examiner* — Caroline N Butcher
(74) *Attorney, Agent, or Firm* — Niels Haun; Dann, Dorfman, Herrell & Skillman, P.C.

(57) ABSTRACT

A device for centering a sensor assembly in a bore comprises a first support and a second support axially spaced apart along a central longitudinal axis of the device, one or both of the first and second supports configured to slide axially along the central longitudinal axis, and a plurality of arm assemblies, each arm assembly pivotally connected to the first and second supports by a respective pivot joint. One or both supports comprise an adjustment mechanism configured to set a maximum outer diameter of the device.

21 Claims, 10 Drawing Sheets

DEVICE FOR CENTERING A SENSOR ASSEMBLY IN A BORE

CORRESPONDING APPLICATION

This application is based on the provisional specification filed in relation to New Zealand Patent Application Number 794016, the entire contents of which is incorporated herein by reference.

TECHNICAL FIELD

This invention relates to devices for use in centering sensor equipment down a bore such as a pipe, a wellbore or a cased wellbore, and in particular to devices for use in centering sensor equipment in wireline logging applications.

BACKGROUND

Hydrocarbon exploration and development activities rely on information derived from sensors which capture data relating to the geological properties of an area under exploration. One approach used to acquire this data is through wireline logging. Wireline logging is performed in a wellbore immediately after a new section of hole has been drilled, referred to as open-hole logging. These wellbores are drilled to a target depth covering a zone of interest, typically between 1000-5000 meters deep. A sensor package, also known as a "logging tool" or "tool-string" is then lowered into the wellbore and descends under gravity to the target depth of the wellbore well. The logging tool is lowered on a wireline—being a collection of electrical communication wires which are sheathed in a steel cable connected to the logging tool. The steel cable carries the loads from the tool-string, the cable itself, friction forces acting on the downhole equipment and any overpulls created by sticking or jamming. Once the logging tool reaches the target depth it is then drawn back up through the wellbore at a controlled rate of ascent, with the sensors in the logging tool operating to generate and capture geological data.

Wireline logging is also performed in wellbores that are lined with steel pipe or casing, referred to as cased-hole logging. After a section of wellbore is drilled, casing is lowered into the wellbore and cemented in place. The cement is placed in the annulus between the casing and the wellbore wall to ensure isolation between layers of permeable rock layers intersected by the wellbore at various depths. The cement also prevents the flow of hydrocarbons in the annulus between the casing and the wellbore which is important for well integrity and safety. Oil wells are typically drilled in sequential sections. The wellbore is "spudded" with a large diameter drilling bit to drill the first section. The first section of casing is called the conductor pipe. The conductor pipe is cemented into the new wellbore and secured to a surface well head. A smaller drill bit passes through the conductor pipe and drills the surface hole to a deeper level. A surface casing string is then run in hole to the bottom of the hole. This surface casing, commonly 20" (nominal OD) is then cemented in place by filling the annulus formed between the surface casing and the new hole and conductor casing. Drilling continues for the next interval with a smaller bit size. Similarly, intermediate casing (e.g. 13⅜") is cemented into this hole section. Drilling continues for the next interval with a smaller bit size. Production casing (e.g. 9⅝" OD) is run to TD (total depth) and cemented in place. A final casing string (e.g. 7" OD) is cemented in place from a liner hanger from the previous casing string. Therefore, the tool-string must transverse down a cased-hole and may need to pass into a smaller diameter bore.

There is a wide range of logging tools which are designed to measure various physical properties of the rocks and fluids contained within the rocks. The logging tools include transducers and sensors to measure properties such as electrical resistance, gamma-ray density, speed of sound and so forth. The individual logging tools are combinable and are typically connected together to form a logging tool-string. Some sensors are designed to make close contact with the borehole wall during data acquisition whilst others are ideally centered in the wellbore for optimal results. These requirements need to be accommodated with any device that is attached to the tool-string. A wireline logging tool-string is typically in the order of 20 ft to 100 ft long and 2" to 5" in diameter.

In cased hole, logging tools are used to assess the strength of the cement bond between the casing and the wellbore wall and the condition of the casing. There are several types of sensors and they typically need to be centered in the casing. One such logging tool utilises high frequency ultrasonic acoustic transducers and sensors to record circumferential measurements around the casing. The ultrasonic transmitter and sensor are mounted on a rotating head connected to the bottom of the tool. This rotating head spins and enables the sensor to record azimuthal ultrasonic reflections from the casing wall, cement sheath, and wellbore wall as the tool is slowly winched out of the wellbore. Other tools have transmitters and sensors that record the decrease in amplitude, or attenuation, of an acoustic signal as it travels along the casing wall. It is important that these transducers and sensors are well centered in the casing to ensure that the data recorded is valid. Other logging tools that measure fluid and gas production in flowing wellbores may also require sensor centralisation. Logging tools are also run in producing wells to determine flow characteristics of produced fluids. Many of these sensors also require centralisation for the data to be valid.

In open hole (uncased wellbores), logging tools are used to scan the wellbore wall to determine the formation structural dip, the size and orientation of fractures, the size and distribution of pore spaces in the rock and information about depositional environment. One such tool has multiple sensors on pads that contact the circumference of the wellbore to measure micro-resistivity. Other tools generate acoustic signals which travel along the wellbore wall and are recorded by multiple receivers spaced along the tool and around the azimuth of the tool. As with the cased hole logging tools, the measurement from these sensors is optimised with good centralisation in the wellbore.

The drilling of wells and the wireline logging operation is an expensive undertaking. This is primarily due to the capital costs of the drilling equipment and the specialised nature of the wireline logging systems. It is important for these activities to be undertaken and completed as promptly as possible to minimise these costs. Delays in deploying a wireline logging tool are to be avoided wherever possible.

One cause of such delays is the difficulties in lowering wireline logging tools down to the target depth of the wellbore. The logging tool is lowered by the wireline cable down the wellbore under the force of gravity alone. The cable, being flexible, cannot push the tool down the wellbore. Hence the operator at the top of the well has very little control of the descent of the logging tool.

The chances of a wireline logging tools failing to descend is significantly increased with deviated wells. Deviated wells do not run vertically downwards and instead extend downward and laterally at an angle from vertical. Multiple deviated wells are usually drilled from a single surface location to allow a large area to be explored and produced. As wireline logging tools are run down a wellbore with a cable under the action of gravity, the tool-string will drag along the low side or bottom of the wellbore wall as it travels downwards to the target depth. The friction or drag of the tool-string against the wellbore wall can prevent to tool descending to the desired depth. The long length of a tool string can further exacerbate problems with navigating the tool string down wellbore.

With reference to FIG. 1, in deviated wells the weight of the tool-string exerts a lateral force (PW) perpendicular to the wellbore wall. This lateral force results in a drag force which acts to prevent the tool-string descending the wellbore. The axial component of tool-string weight (AW) acts to pull the tool-string down the wellbore and this force is opposed by the drag force which acts in the opposing direction. As the well deviation increases the axial component of tool weight (AW) reduces and the lateral force (PW) increases. When the drag resulting from the lateral force (PW) equals the axial component (AW) of tool-string weight the tool will not descend in the wellbore.

As hole deviation increases, the sliding friction or drag force can prevent the logging tool descending. The practical limit is 60° from the vertical, and in these high angle wells any device that can reduce friction is very valuable. The drag force is the product of the lateral component of tool weight acting perpendicular to the wellbore wall and the coefficient of friction. It is desirable to reduce the coefficient of friction to reduce the drag force. The coefficient of friction may be reduced by utilising low friction materials, such as Teflon. The drag force may also be reduced by using wheels.

A common apparatus to centralise logging tools is a bow-spring centraliser. Bow-spring centralisers incorporate a number of curved leaf springs. The leaf springs are attached at their extremities to an attachment structure that is fixed to the logging tool. The midpoint of the curved leaf spring (or bow) is arranged to project radially outward from the attachment structure and tool string. When the bow-spring centraliser is not constrained by the wellbore, the outer diameter of the bow-spring centraliser is greater than the diameter of the wellbore or casing in which it is to be deployed. Once deployed in the wellbore, the bow-springs are flattened and the flattened bow springs provide a centering force on the tool string. In deviated wells this centering force must be greater than the lateral weight component of the tool string acting perpendicular to the wellbore or casing wall. Consequently, more centering force is required at greater well deviations. If the centering force is too small the centraliser will collapse and the tool sensors are not centered. If the centralising force is too great the excessive force will induce unwanted drag which may prevent the tool descending or cause stick-slip motion of the logging tool. Stick-slip is where the tool moves up the wellbore in a series of spurts rather than at a constant velocity. Stick-slip action will compromise or possibly invalidate the acquired measurement data. The practical limit for gravity decent with using bow spring centralisers is in the order of 60 degrees from the vertical. Wellbores are vertical at shallow depths and build deviation with depth. Consequently, the centralisation force that is necessary varies within the same wellbore. As the bow spring centraliser must be configured for the highest deviations, invariably there is more drag than what is necessary over much of the surveyed interval.

With bow spring centralisers, the centralising force is greater in small diameter wellbores, as the leaf springs have greater deflection (more compressed), than in large diameter wellbores. Consequently, stronger or multiple bowsprings are required in larger hole sizes. These centralisers usually have "booster" kits to impart more centering force in larger wellbores or those with higher deviations.

At deviations greater than 60 degrees other methods must be used to overcome the frictional forces and enable the tool string to descend in the wellbore. One method is to use a drive device (tractor) connected to the tool string. Tractors incorporate powered wheels that forcibly contact the wellbore wall in order to drive the tool string downhole. Another method is to push the tool string down hole with drill pipe or coiled tubing. These methods involve additional risk, more equipment and involve more time and therefore cost substantially more.

In order to reduce the centraliser drag, wheels may be attached to the centre of the bow spring to contact the wellbore wall. However, the fundamental problems associated with the collapse of the leafspring or over-powering persist.

Another known type of centraliser consists of a set of levers or arms with a wheel at or near where the levers are pivotally connected together. There are multiple sets of lever-wheel assemblies disposed at equal azimuths around the central axis of the device. There are typically between three and six sets. The ends of each lever set are connected to blocks which are free to slide axially on a central mandrel of the centraliser device. Springs are used force these blocks to slide toward each other forcing the arms to defect at an angle to the centraliser (and tool string) axis so that the wheels can extend radially outward to exert force against the wellbore wall. With this type of device, the centering force depends on the type and arrangement of the energising apparatus or springs. The centraliser device is typically energised by means of either axial or radial spring or a combination of both. The advantage of this type of centraliser is that drag is reduced by the wheels which roll, rather than slide along the wellbore wall. However, the limitations described above still apply. Namely, the centralising force is greater in small diameter wellbores, where the springs undergo greater deflection, than in large diameter wellbores. And at increased well deviations, more centering force is required. If the centering force is too small the centraliser will collapse and the tool sensors are not centered. If the centralising force is too great the excessive force will induce unwanted drag which may prevent the tool descending or cause stick-slip motion of the logging tool.

The reference to any prior art in the specification is not, and should not be taken as, an acknowledgement or any form of suggestion that the prior art forms part of the common general knowledge in any country.

DISCLOSURE OF INVENTION

It is an object of the present invention to address any one or more of the above problems or to at least provide the industry with a useful device for centering sensor equipment in a bore or pipe.

According to one aspect of the present invention there is provided a device for centering a sensor assembly in a bore, the device comprising:

a first support and a second support axially spaced apart along a central longitudinal axis of the device, wherein one or both of the first and second supports is a sliding support configured to slide axially along the central longitudinal axis, and a plurality of arm assemblies pivotally connected between the first and second supports, each arm assembly pivotally connected to the first and second supports by a respective pivot joint, and a mechanical stop providing a limit of axial travel for the sliding support to thereby define a maximum outer diameter of the device, wherein the sliding support comprises a sleeve with one or more axial slots, the sleeve configured to slide along the central longitudinal axis, and the mechanical stop comprises one or more projections extending from a central mandrel of the device, the one or more projections corresponding with the one or more slots, each projection received in a said slot.

In some embodiments, the sleeve comprises a plurality of said axial slots and the mechanical stop comprises a plurality of said projections received in the slots, the plurality of axial slots and the plurality of projections spaced circumferentially apart around the central longitudinal axis.

In some embodiments, the one or more projections bear against the sleeve to provide the limit of axial travel.

In some embodiments, each of the one or more projections bears against an end of the corresponding said axial slot to provide the limit of axial travel.

In some embodiments, the mechanical stop comprises a ring attached to the projections, the ring extending around an outside of the sleeve to allow the sleeve to slide relative to the ring.

In some embodiments, the sleeve bears against the ring to provide the limit of axial travel In some embodiments, the sliding support comprises an adjustment mechanism configured to set a maximum outer diameter of the device, and wherein sliding support comprises a collar mounted to the sleeve by a threaded engagement, the collar bears against the ring to provide the limit of axial travel, the sleeve and collar with threaded engagement thereby providing the adjustment mechanism.

According to another aspect of the present invention there is provided a device for centering a sensor assembly in a bore, the device comprising:

a first support and a second support axially spaced apart along a central longitudinal axis of the device, one or both of the first and second supports configured to slide axially along the central longitudinal axis, and a plurality of arm assemblies pivotally connected between the first and second supports, each arm assembly pivotally connected to the first and second supports by a respective pivot joint, wherein one or both supports comprise an adjustment mechanism configured to set a maximum outer diameter of the device.

One or both supports comprise a sleeve and a collar mounted to the sleeve by a threaded engagement, the arm assemblies pivotally connected to the sleeve or collar, the sleeve and collar with threaded engagement providing the adjustment mechanism.

In some embodiments:

the sleeve is configured to slide axially along the central longitudinal axis, and the collar is mounted to the sleeve by the threaded engagement to provide relative axial movement therebetween to adjust an axial position of the respective pivot joints of the arm assemblies along the longitudinal axis to correspondingly set the maximum outside diameter of the device.

In some embodiments:

the support bears against a mechanical stop to define an axial travel limit for the sleeve along the longitudinal axis and a corresponding maximum outward radial movement of the arm assemblies, and relative axial movement of the collar on the sleeve adjusts the axial position of the respective pivot joints of the arm assemblies relative to the mechanical stop to correspondingly set the maximum outside diameter of the device.

In some embodiments:

the arm assemblies are pivotally connected to the collar, and the sleeve bears against the mechanical stop to define a maximum axial travel of the support along the longitudinal axis, wherein relative axial movement of the collar on the sleeve adjusts the axial position of the collar and the respective pivot joints of the arm assemblies relative to the mechanical stop to correspondingly set the maximum outside diameter of the device.

In some embodiments, the first and second supports each comprise a said adjustment mechanism, and wherein the threaded engagement of the adjustment mechanism of the first or second support comprises a right-hand thread, and the threaded engagement of the adjustment mechanisms of the other one of the first and second supports comprises a left-hand thread, so that adjustment of the maximum outer diameter is made by rotating the arm assemblies relative to the sleeves of the first and second supports about the longitudinal axis In some embodiments:

the arm assemblies are pivotally connected to the sleeve, and the collar bears against the mechanical stop to define the axial travel limit for the sleeve along the longitudinal axis, wherein relative axial movement of the collar on the sleeve adjusts the axial position of the sleeve and the respective pivot joints of the arm assemblies relative to the mechanical stop to correspondingly set the maximum outside diameter of the device.

In some embodiments, the sleeve comprises one or more axial slots to receive the mechanical stop to bear against the collar.

In some embodiments, the mechanical stop comprises one or more projections extending from a central mandrel of the device, the one or more projections corresponding with the one or more slots, each projection received in a said slot.

In some embodiments, the sleeve comprises a plurality of said axial slots and the mechanical stop comprises a plurality of said projections received in the slots.

In some embodiments, the mechanical stop comprises a ring attached to the projections, the collar bearing against the ring.

In some embodiments, each projection comprises a pin and/or fastener.

In some embodiments, the adjustment mechanism comprises a locking member to lock the position of the adjustment mechanism and therefore the maximum outer diameter setting.

In some embodiments, the locking member is a threaded ring mounted to the sleeve to engage the collar by relative rotation provided for by the threaded engagement.

In some embodiments, each arm assembly comprises a first arm connected to one of the support by a first pivot joint, and second arm connected to the other one of the supports by a second pivot joint, the first and second arms coupled together.

In some embodiments, the first and second arms are pivotally connected together by a third pivot joint.

The adjustment mechanism is configured to set the maximum outer diameter of the device within a range of maximum outer diameters, between a smallest maximum outer diameter and a largest maximum outer diameter.

The device comprises one or more springs to bias the arm assemblies radially outwards.

In some embodiments, one of the support members is configured to slide axially and the other one of the support members is fixed against sliding axially, and the fixed support member comprises a said adjustment mechanism, the adjustment mechanism of the fixed support member comprising a collar and a threaded engagement between the collar and a central mandrel, the arm assemblies pivotally attached to the collar.

In some embodiments, one of the first and second support members is configured to slide axially and the other one of the first and second support members is fixed to the mandrel, the fixed support comprising a said adjustment mechanism, and wherein the sleeve of the fixed support member is fixed to or integrally formed with the mandrel.

In some embodiments, the sleeve of the fixed support member is integrally formed with the mandrel such that the collar of the fixed support member is threadingly engaged with the mandrel by the threaded engagement.

The second described aspect of the invention may have any one or more of the features of the above first described aspect of the invention.

Unless the context suggests otherwise, the term "wellbore" may to refer to both cased and uncased wellbores. Thus, the term 'wellbore wall' may refer to the wall of a wellbore or the wall of a casing within a wellbore.

Unless the context suggests otherwise, the term "tool string" refers to an elongate sensor package or assembly also known in the industry as a "logging tool" and may include components other than sensors such as guide and orientation devices and carriage devices attached to sensor components or assemblies of the tool string. A tool string may include a single elongate sensor assembly, or two or more sensor assemblies connected together.

Unless the context clearly requires otherwise, throughout the description and the claims, the words "comprise", "comprising", and the like, are to be construed in an inclusive sense as opposed to an exclusive or exhaustive sense, that is to say, in the sense of "including, but not limited to". Where in the foregoing description, reference has been made to specific components or integers of the invention having known equivalents, then such equivalents are herein incorporated as if individually set forth.

The invention may also be said broadly to consist in the parts, elements and features referred to or indicated in the specification of the application, individually or collectively, in any or all combinations of two or more of said parts, elements or features, and where specific integers are mentioned herein which have known equivalents in the art to which the invention relates, such known equivalents are deemed to be incorporated herein as if individually set forth.

Further aspects of the invention, which should be considered in all its novel aspects, will become apparent from the following description given by way of example of possible embodiments of the invention.

BRIEF DESCRIPTION OF THE DRAWINGS

An example embodiment of the invention is now discussed with reference to the Figures.

FIG. 2A is an isometric view of the centraliser with arm assemblies of the centraliser in a radially outward position and with the centraliser set to a smallest maximum outside diameter. FIG. 2B is an isometric view of the centraliser with arm assemblies of the centraliser in a radially outward position and with the centraliser set to a largest maximum outside diameter. FIG. 2C is a side view of the centraliser corresponding with FIG. 2A. FIG. 2D is a side view of the centraliser corresponding with FIG. 2B. FIG. 2E is an end view of the centraliser corresponding with FIG. 2A. FIG. 2F is an end view of the centraliser corresponding with FIG. 2B. FIG. 2G shows the centraliser set to the smallest maximum outer diameter corresponding with FIG. 2A but with the arm assemblies moved to a radially inward position. FIG. 2H is an end view of the centraliser corresponding with FIG. 2G.

FIG. 5A is an isometric view of the centraliser with arm assemblies of the centraliser in a radially outward position and with the centraliser set to a mid-range maximum outside diameter. FIG. 5B is an isometric view of the centraliser with arm assemblies of the centraliser in a radially outward position and with the centraliser set to a largest maximum outside diameter. FIG. 5C is a side view of the centraliser corresponding with FIG. 5A. FIG. 5D is a side view of the centraliser corresponding with FIG. 5B. FIG. 5E is an end view of the centraliser corresponding with FIG. 5A. FIG. 5F is an end view of the centraliser corresponding with FIG. 5B. FIG. 5G shows the centraliser set to the largest maximum outer diameter corresponding with FIG. 5B but with the arm assemblies moved to a radially innermost position. FIG. 5H is an end view of the centraliser corresponding with FIG. 5G. FIG. 5I is a section view of the centraliser on a section plane through a longitudinal centre of the device.

BEST MODES FOR CARRYING OUT THE INVENTION

Figure 1:
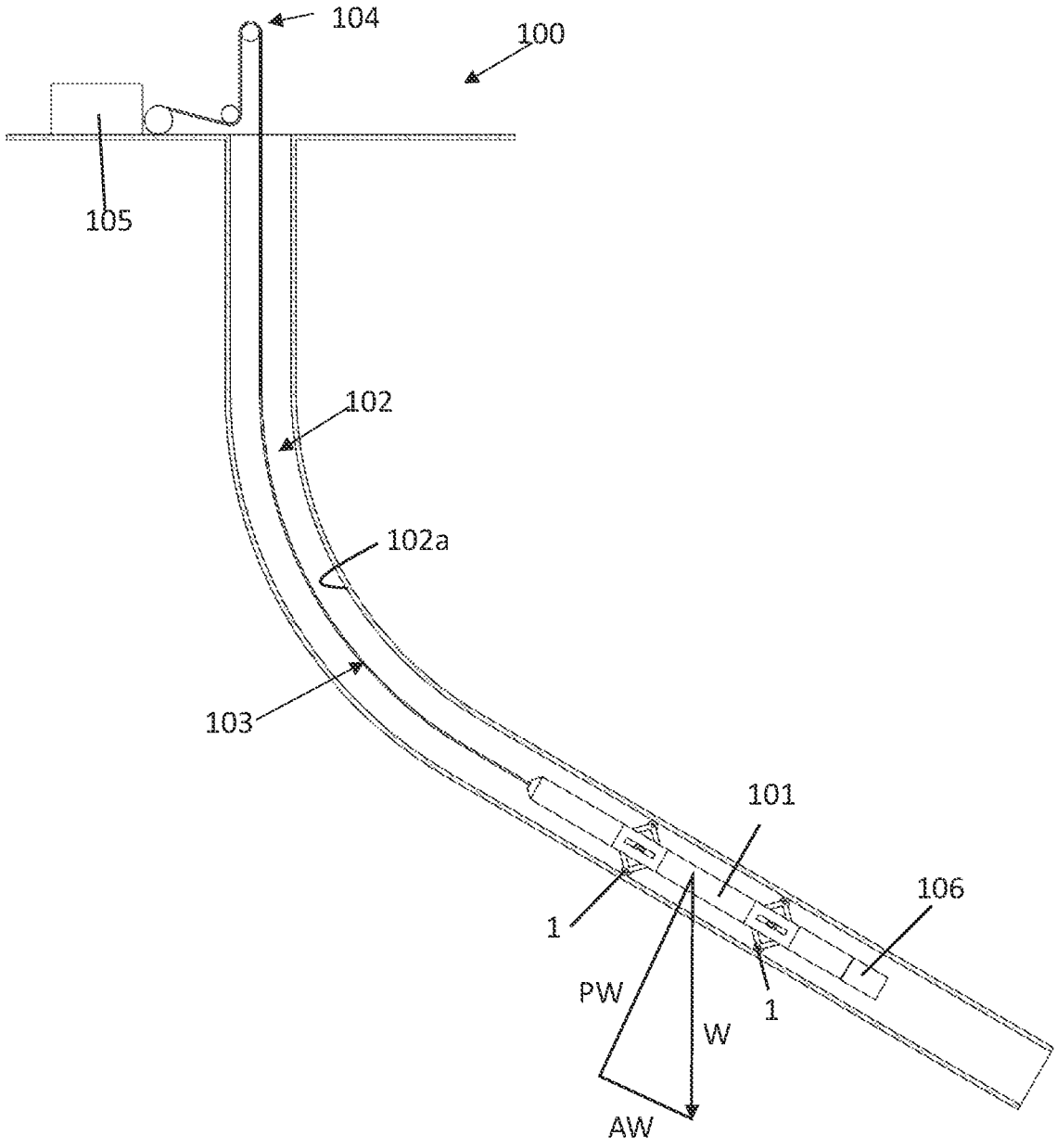
FIG. 1 is a schematic representation of a well site and a tool string descending a wellbore in a wireline logging operation.

FIG. 1 provides a schematic representation of a well site 100. A logging tool string 101 is lowered down the wellbore 102 on a wireline 103. Wellsite surface equipment includes sheave wheels 104 typically suspended from a derrick and a winch unit 105 for uncoiling and coiling the wireline to and from the wellbore, to deploy and retrieve the logging tool 101 to and from the wellbore to perform a wellbore wireline logging operation. The logging tool string 101 may include one or more logging tools each carrying one or more sensors 106 coupled together to form the logging tool string 101. The wireline 102 includes a number of wires or cables to provide electrical power to the one or more sensors 106 and transmit sensor data to the wellsite surface. One or more centralising devices 1 are provided to the logging tool 101 to centralise the logging tool 101 in the wellbore 102.

FIGS. 2A to 2H illustrate a centralising device 1 to be provided with or as part of the tool string 101. The centralising device (or centraliser) may comprise a coupling 2 or interface (illustrated schematically) at each end to connect the centraliser 1 to other components of the tool string 101. The couplings may include electrical or hydraulic connections to provide electrical and hydraulic communication from the wireline to the wireline logging tool and/or between wireline tools. Alternatively, the centraliser device may be integral with the wireline logging tool, e.g. the outer housing of the logging tool may form a central mandrel of the centraliser. Alternatively, the centraliser device may slip over the outside of the wireline logging tool (housing) thereby avoiding any electrical or hydraulic connections with the tool string and wireline. The couplings or interfaces may be any suitable coupling or interface known in the art. The term 'mandrel' may be used herein to refer to both a mandrel of the centraliser and a tool housing.

A plurality of arm assemblies (linkages) 3 are spaced circumferentially apart around a longitudinal axis 4 of the device 1. The arm assemblies 3 are configured to move axially and radially to engage the wellbore wall 102*a* to provide a centering force to maintain the tool string 101 in the centre of the wellbore 102. The example device 1 comprises four arm assemblies 3, however there may be three or more arm assemblies.

Figure 2A:
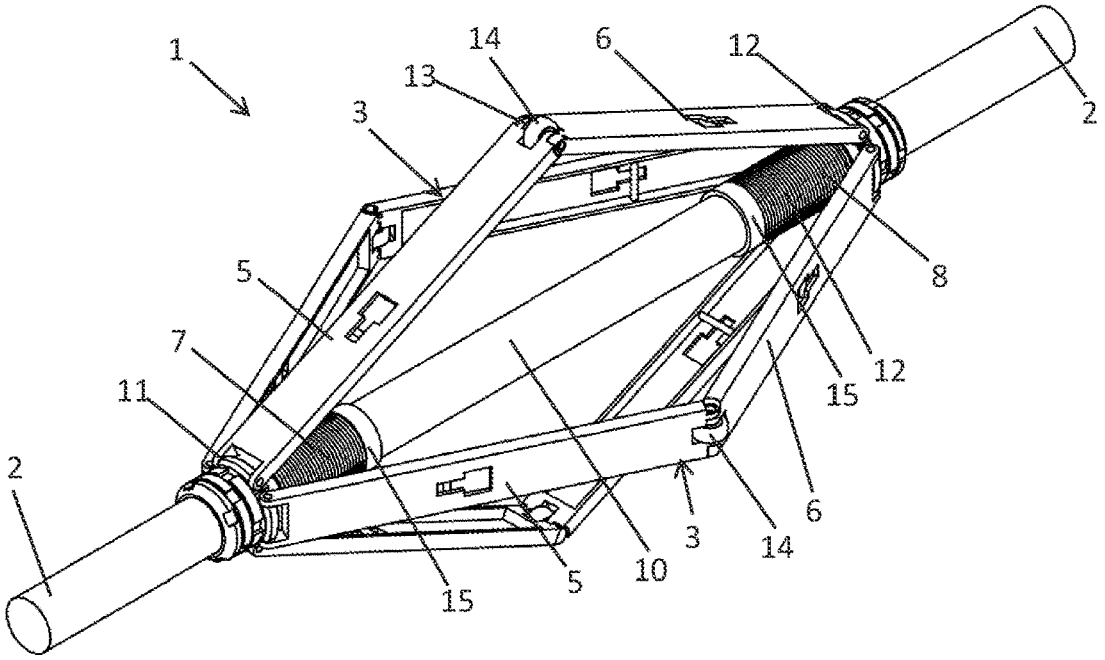
FIGS. 2A to 2H provide representations of a centralising device (a centraliser) according to one embodiment of the present invention.
Figure 2B:
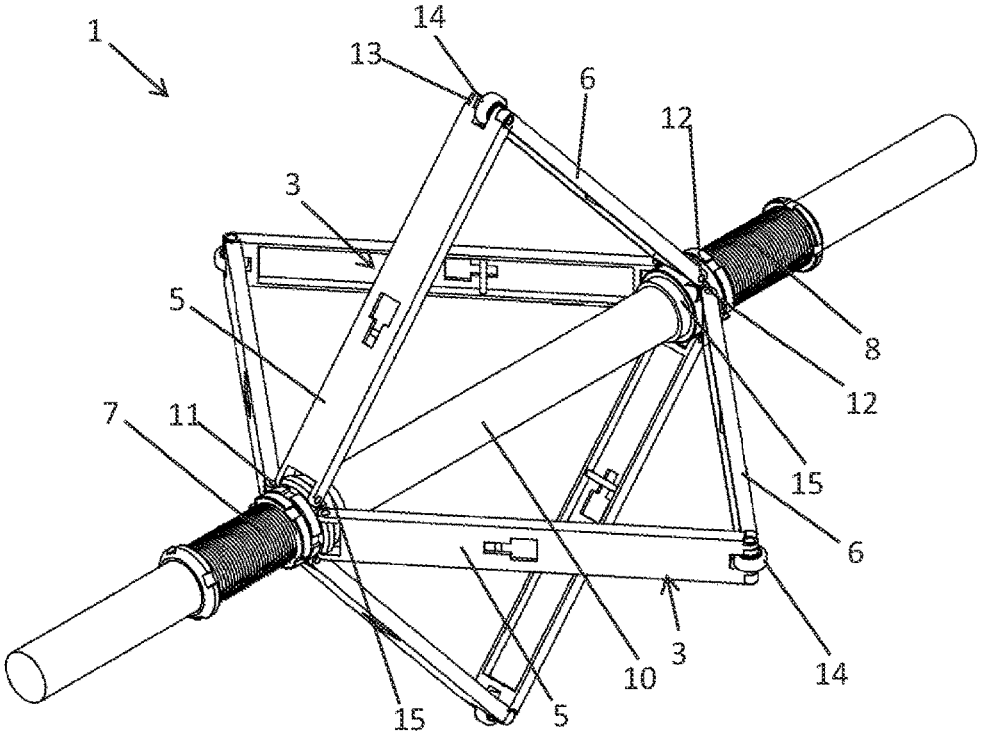
Figure 2C:
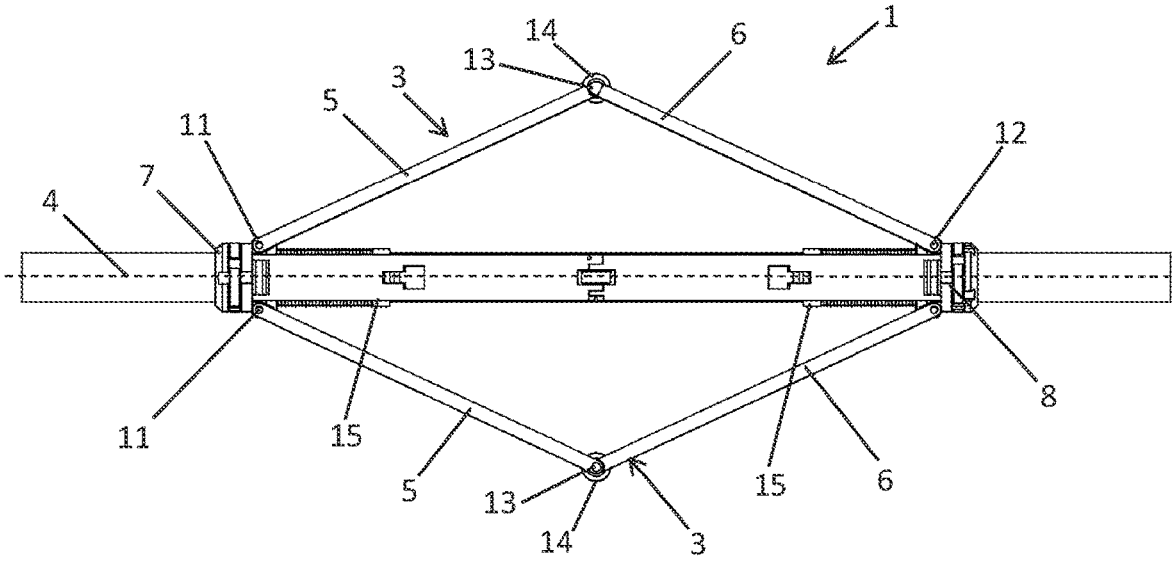
Figure 2D:
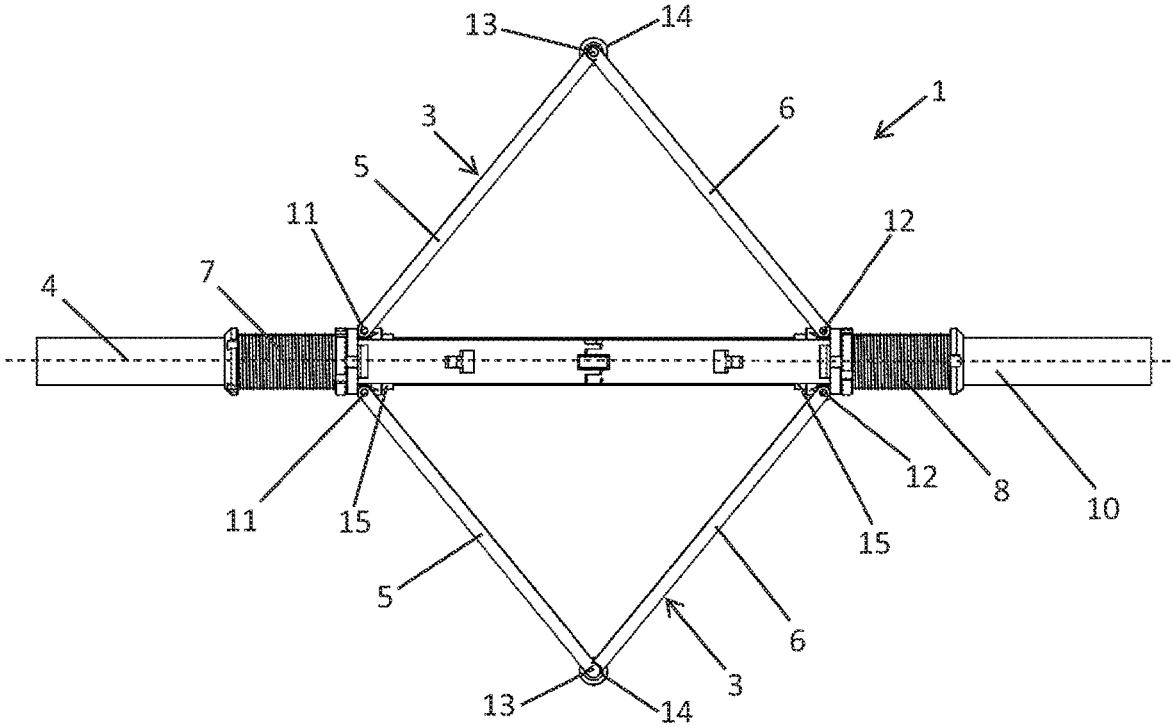
Figure 2E:
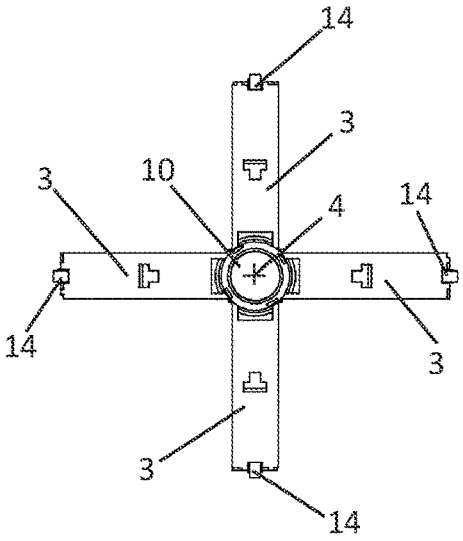
Figure 2F:
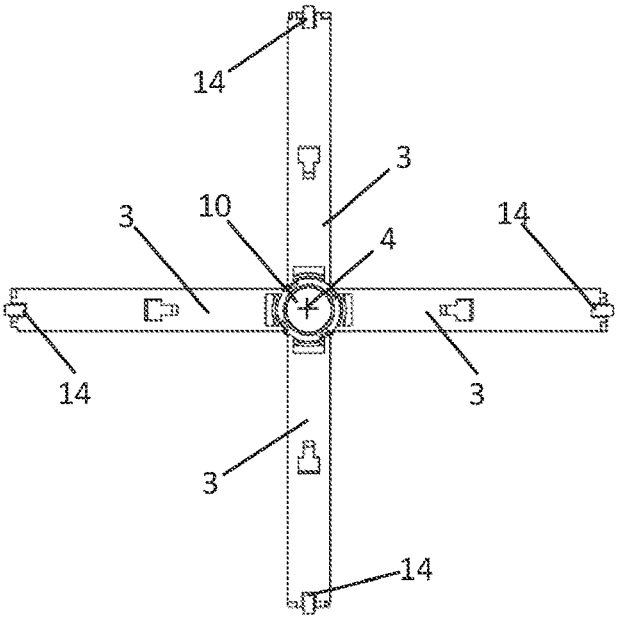
Figure 2G:
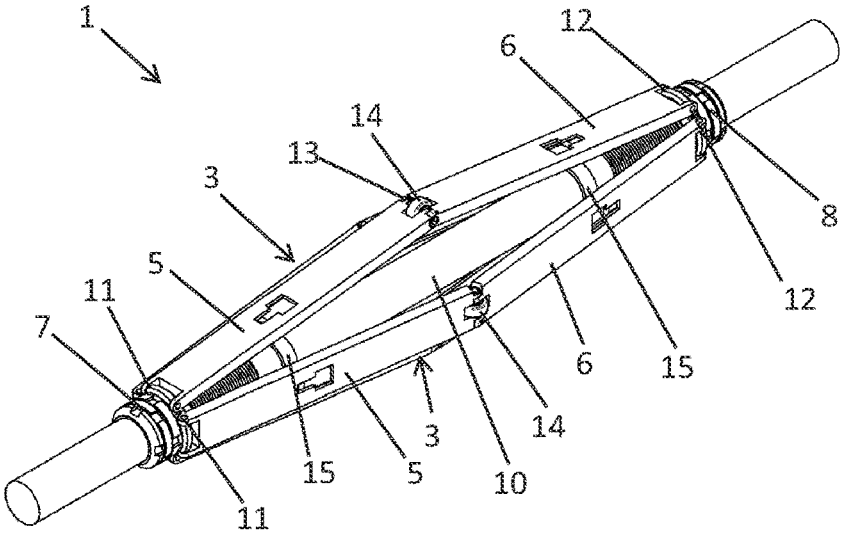
Figure 2H:
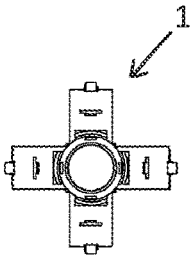

The arm assemblies 3 are pivotally coupled between two supports, a first support 7 and a second support 8. Each arm assembly or linkage comprises a first arm or link 5 pivotally connected to one of the supports 7, 8 by a first pivot joint 11 having a first pivot axis 11*a*, and a second arm or link 6 pivotally connected to the other one of the supports 7, 8 by a second pivot joint 12 having a second pivot axis 12*a*. The first and second arms 5, 6 are pivotally coupled together and in the illustrated example are pivotally attached via a third pivot joint 13 having a third pivot axis 13*a*. One or both of the supports 7, 8 are configured to move/slide axially along a longitudinal axis 4 of the device 1 to cause the arm assemblies 3 to move radially to engage the wellbore wall by pivoting of the first and second arms 5, 6 about the respective first 11*a*, second 12*a* and third 13*a* pivot axes. One or both supports 7, 8 may slide axially on a central member or mandrel 10 of the centraliser or on a body of the tool string. The axial movement of the support or supports 7, 8 moves the arm assemblies 3 between a minimum outside diameter with the arm assemblies 3 in a radially inward position as shown in FIGS. 2G and 2H and a maximum outer diameter with the arm assemblies 3 in a radially outward position as shown in FIGS. 2A to 2F. As will be described below, the maximum outer diameter of the device 1 is adjustable between a smallest maximum outer diameter as shown in FIGS. 2A, 2C and 2E, and a largest maximum outer diameter as shown in FIGS. 2B, 2D and 2F.

Each arm assembly 3 carries a roller or wheel 14 (herein wheel) to contact the wellbore wall to reduce friction between the wellbore wall 102*a* and the tool string 101 as the tool string 101 traverses the well bore 102. The wheel 14 is located at or adjacent the third pivot joint 13. The wheel 14 may have a rotational axis colinear with the pivot axis 13*a* of the third pivot joint 13 as shown in the figures or may be located adjacent the third pivot joint 13, for example the wheel may be rotationally mounted to the first arm 5 or the second arm 6 adjacent the third pivot joint 13.

Figure 4:
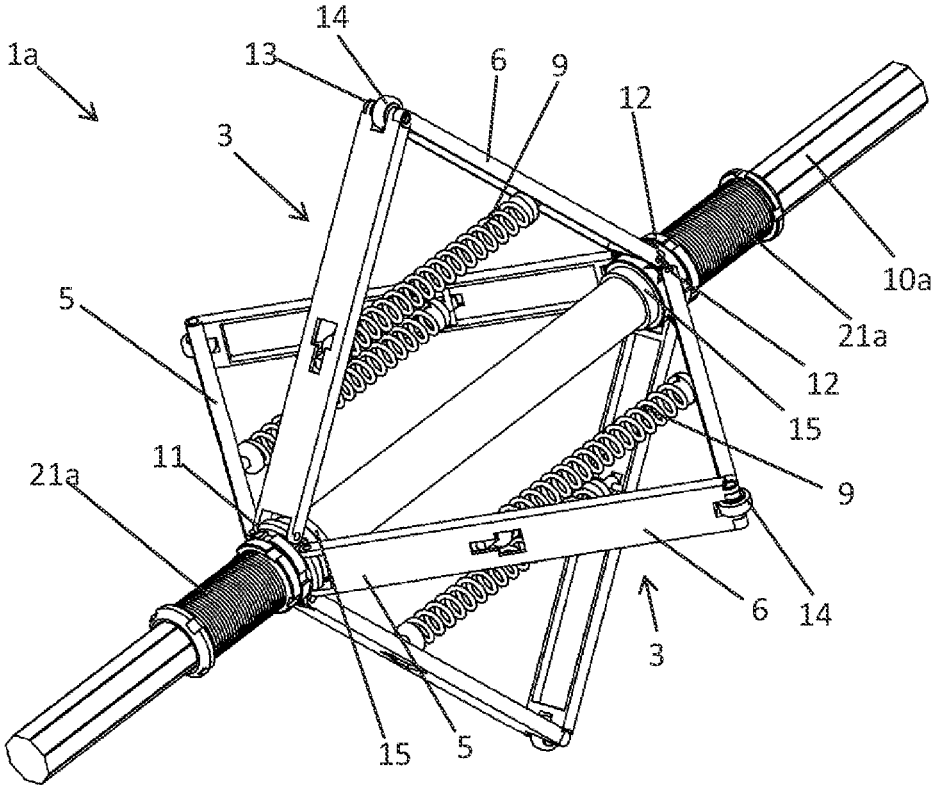
FIG. 4 shows the centraliser of FIGS. 2A to 2H but comprising a mandrel with a facetted outer surface to rotationally key sliding supports of the centraliser to the mandrel.
Figure 5A:
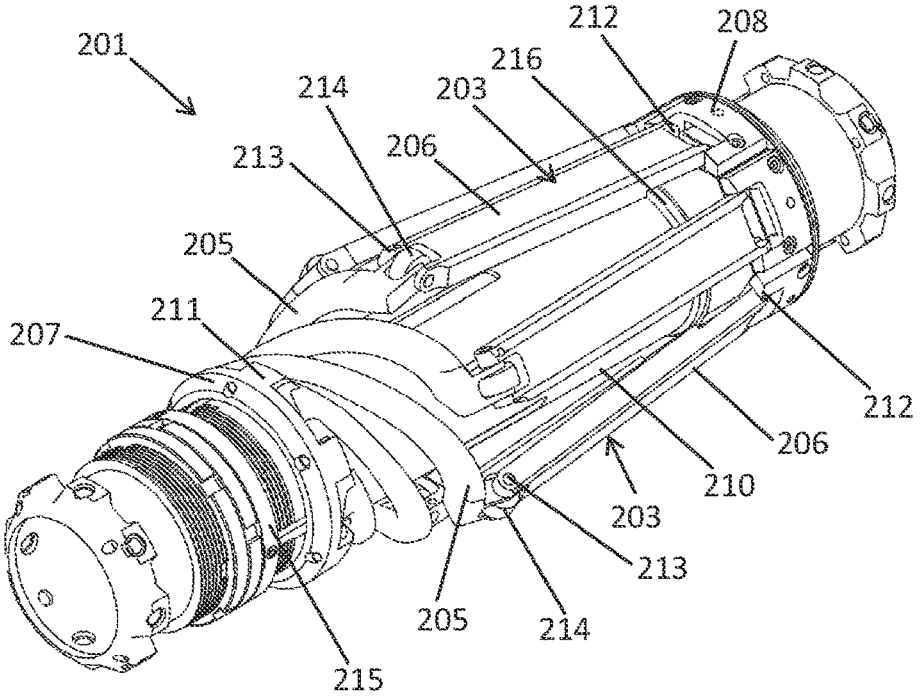
FIGS. 5A to 5I provide representations of a centralising device (a centraliser) according to another embodiment of the present invention.
Figure 5B:
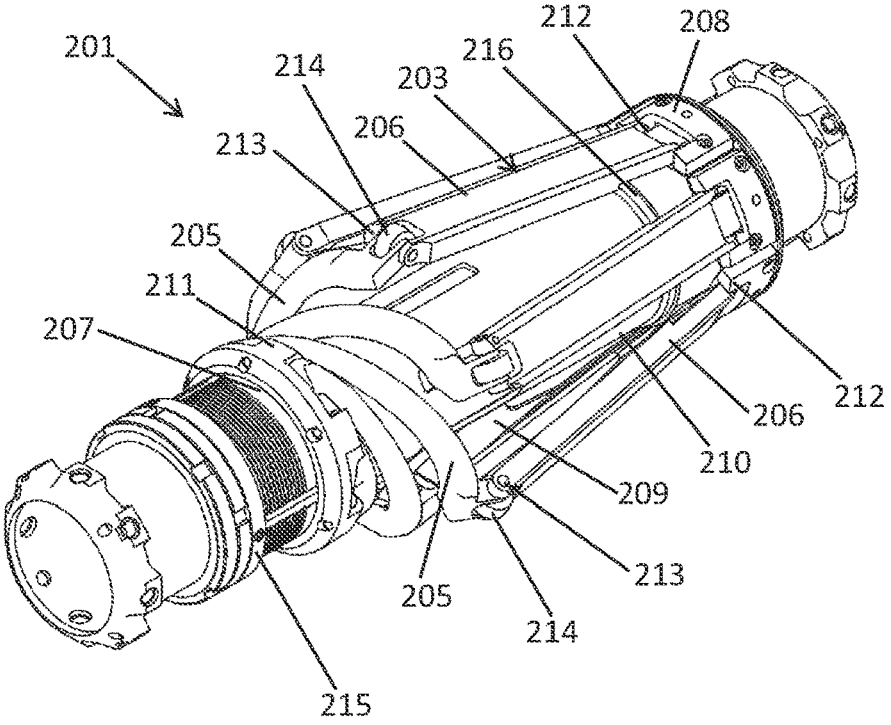
Figure 5C:
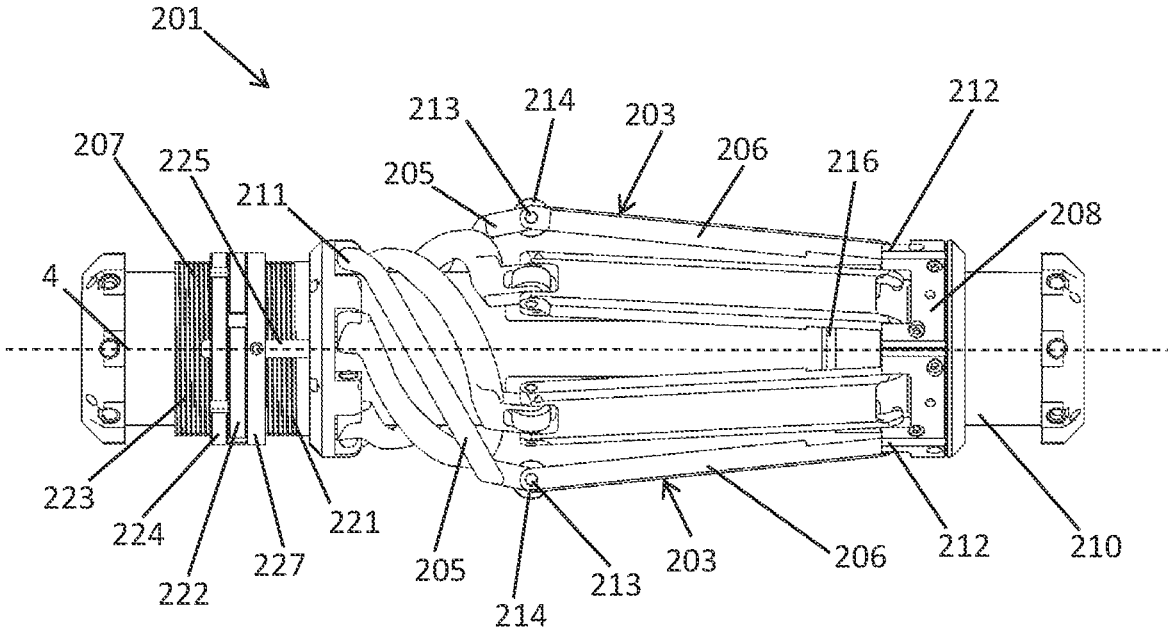
Figure 5D:
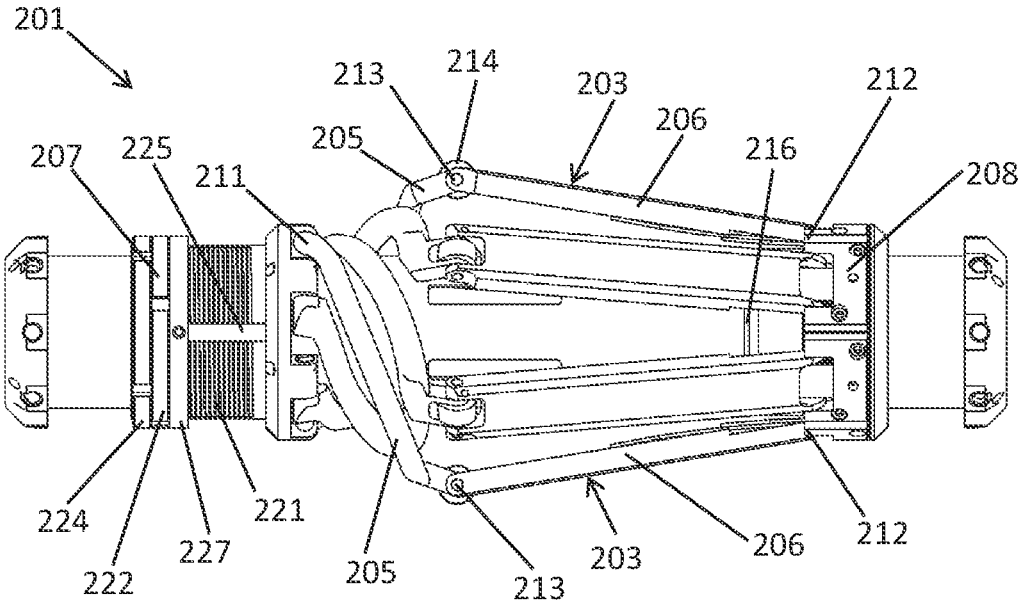
Figure 5E:
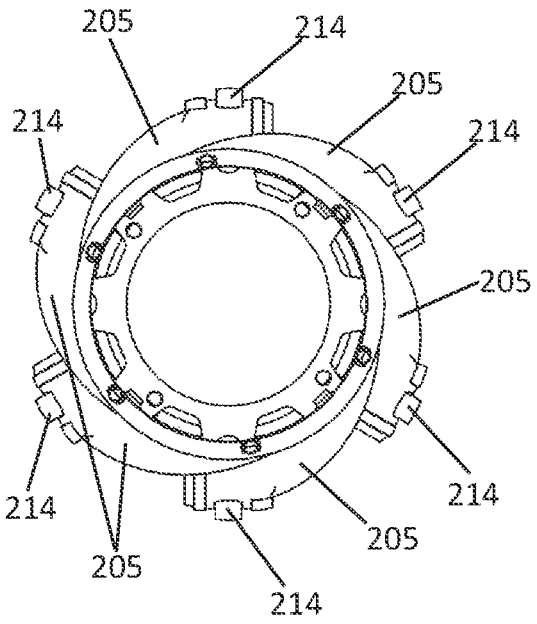
Figure 5F:
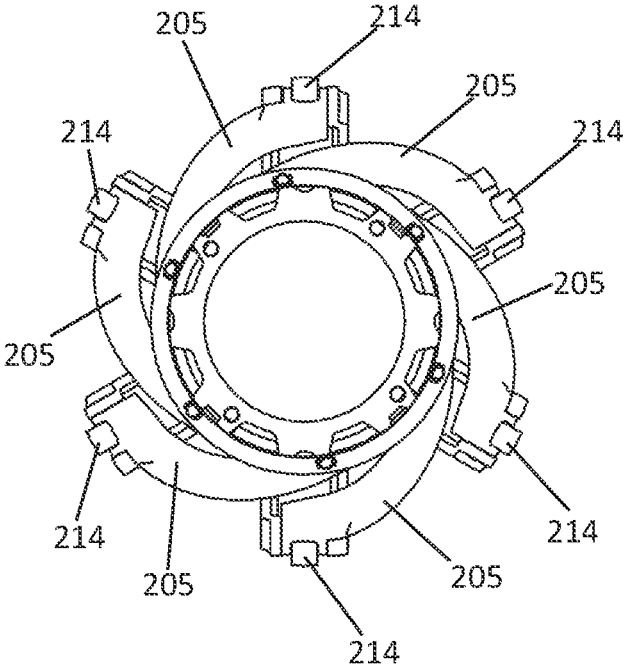
Figure 5G:
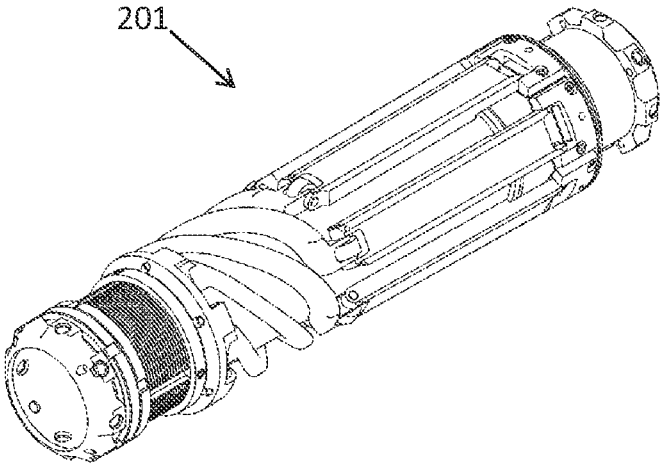
Figure 5H:
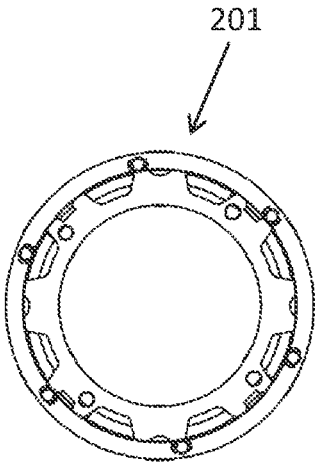
Figure 5I:
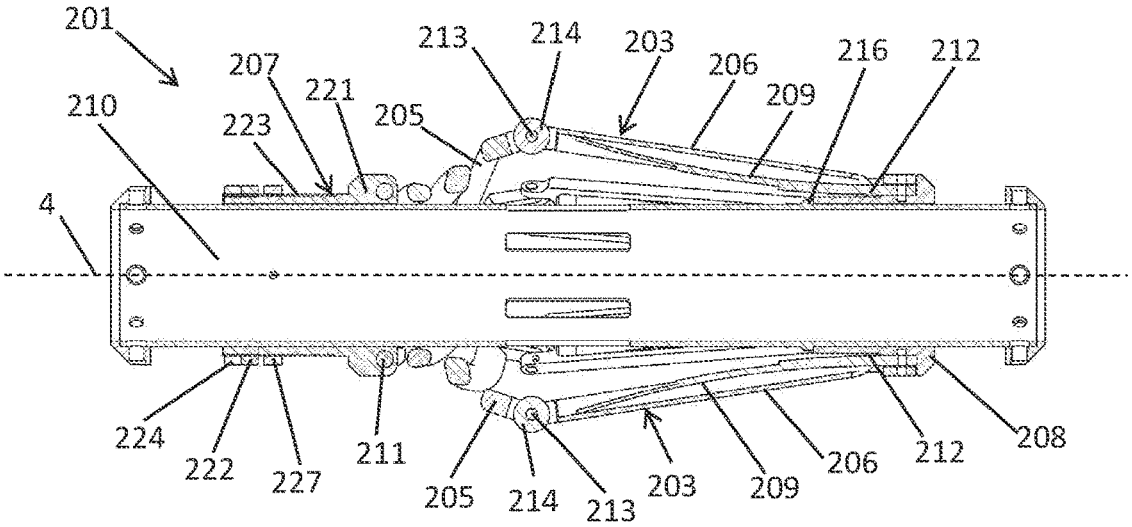

Springs are provided to bias the arm assemblies 3 radially outwards against the wellbore wall 102*a*, to center the centraliser 1 and connected tool string in the wellbore. For example, the device may comprise leaf springs to bias the arms assemblies 3 radially outwards. A radially acting spring may be provided to one or more arm assemblies or each arm assembly. The radial spring or leaf spring may be mounted to a support 7, 8 to act between the support 8 and the arm assembly 3 to provide a radial outward force to the arm assembly 3. By example, the embodiment of FIGS. 5A to 5I comprises a leaf spring 209 acting between support 208 and each arm assembly 203, as best shown in FIG. 5I. Alternatively, one or more radial springs may act between the mandrel 10 and the arm assembly 3 or assemblies 3. In a further alternative, the centraliser may have an axial spring acting on one or both supports to bias the supports axially together to thereby bias the arm assemblies 3 radially outwards against the wellbore wall 102*a*. Axial springs may act between the threaded collars 22 or locking members 24 (described below with reference to FIG. 3) of the supports 7, 8 or between the first and second arms 5, 6 of the arm assemblies 3. Where one of the supports 7, 8 is fixed against axial movement, the centraliser is without an axial spring acting on the fixed support. The axial spring(s) may be coil springs that are colinear with the mandrel or may include a plurality of coil springs arranged circumferentially (azimuthally spaced apart) around the mandrel, for example as described in U.S. Pat. No. 11,136,880, the entire contents of which is incorporated herein by reference. In FIG. 4, the illustrated centraliser comprises an axial spring 9 acting on each arm assembly between the first and second arms, with the springs acting in tension. Alternatively, springs may be arranged to act in compression as described in U.S. Pat. No. 11,136,880. Springs are omitted from FIGS. 2A to 2H to clearly show the other components of the centraliser, however, may comprise axial as shown in FIG. 4, and/or axial springs acting on the collars 22 of the supports or leaf springs 209 as shown in FIG. 5I.

Those skilled in the art will understand that other types of springs and spring configurations may be used to power the centraliser such as torsion springs and Belleville Washers for example. A combination of two or more spring devices may also be used, for example one or more springs may be provided end-to-end to impart a combined non-linear spring rate. Alternatively, the pitch of the coil spring may vary over its length to provide a non-linear spring rate. A centraliser according to the present invention may have only axial springs, only radial springs, or a combination of both axial and radial springs. A combination of both axial and radially acting springs may be used to provide a relatively constant radial force. Any known spring arrangement may be provided to power the radial outward movement of the arms of a centraliser according to the present invention, the above-described arrangements are by way of example only.

In a centraliser according to the present invention one or both supports 7, 8 is a support assembly comprising an adjustment mechanism to set a maximum diameter of the centraliser 1 within a range of maximum outer diameters, i.e. between a smallest maximum outer diameter and a largest maximum outer diameter.

The radial extremities of the centraliser provided by the wheels 14 together present or define the outer diameter of the centraliser—the radial extremities of the centraliser provided by the wheels lie on a circle, and the diameter of the circle is the outer diameter of the device. The springs provide a radial force to the arm assemblies 3 with the wheels 14 at the maximum outer diameter so that the centraliser supports the sensor assembly with the wheels at the maximum outer diameter as it traverses along a bore.

The adjustment mechanism prevents the arm assemblies 3 extending radially outside a desired diameter range, to avoid for example difficulties with inserting the device 1 into a bore or passing from a larger diameter to a smaller diameter section of the wellbore or passing through a wellhead control assembly.

The adjustment mechanism may be configured to allow the maximum outer diameter to be set to be equal to or slightly less than a maximum nominal wellbore diameter, thus avoiding the requirement to press the arms radially inwards against the spring force to thereby avoid a higher friction force when passing along a nominal section of the wellbore.

Figure 3:
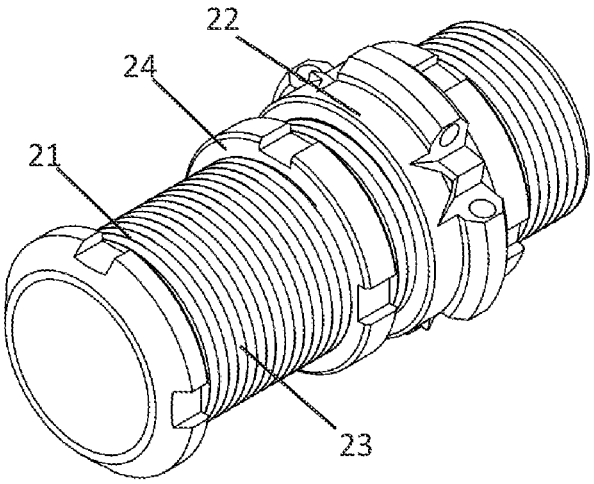
FIG. 3 shows a sliding support assembly from the centraliser of FIGS. 2A to 2H.

With reference to FIG. 3, the one or both supports 7, 8 comprises a sleeve 21 mounted to the mandrel 10 or tool body, and a collar 22 mounted to the sleeve 21 by a threaded engagement therebetween. The sleeve comprises a thread and the collar comprises a corresponding thread, the threads of the sleeve and collar forming the threaded engagement. The sleeve comprises a male thread 23 and the collar a corresponding female thread (obscured from view). The sleeve and collar with threaded engagement therebetween provides the adjustment mechanism. In the illustrated embodiment both supports 7, 8 comprises an adjustment mechanism, however one skilled in the art will appreciate that only one support may be so configured.

In the example of FIGS. 2A to 2H the sleeve 21 is mounted to slide axially along the longitudinal axis 4 of the device. The arm assemblies 3 are pivotally connected to the collar 22. The threaded engagement between the collar and sleeve allows for the axial position of the collar 22 and therefore the corresponding first or second pivot joint 11, 12 to be adjusted along the longitudinal axis 4, to thereby adjust the maximum outer diameter of the arm assemblies 3.

A fixed support may comprise an adjustment mechanism to set the maximum outer diameter of the device 1. Where a support 7, 8, does not slide axially on the mandrel, the 'sleeve' is fixed to the mandrel, for example the sleeve as described herein may be fixed against sliding by grub screws engaged between the sleeve and mandrel, or the sleeve may be integrally formed with the mandrel, in which case the collar may be threadingly engaged with the mandrel. The other support is a sliding support and may be with or without an adjustment mechanism.

In a sliding support 7, 8 as illustrated, axial movement of the support on the mandrel to move the arms radially outwards is limited by a mechanical stop 15 on the mandrel. The support 7, 8 bears against the stop 15 when the arm assemblies are at the maximum outer diameter. The mechanical stop 15 therefore defines the maximum outer diameter of the device 1.

In the illustrated example of FIGS. 2A to 2H, the sleeve 21 bears against the mechanical stop 15 to define the maximum axial travel or limit of travel of the support along the longitudinal axis and therefore the maximum outer diameter of the device. The threaded engagement between the collar 22 and sleeve 21 allows for the axial position of the collar 22 and therefore the respective pivot joints 11, 12 at the collar 22 to be adjusted relative to sleeve 21 and therefore the mechanical stop 15, to correspondingly set the maximum outer diameter of the device. The adjustment mechanism therefore provides for an adjustable mechanical stop relative to the arm assemblies.

Again with reference to FIG. 3, the adjustment mechanism comprises a locking member 24 to lock the position of the adjustment mechanism and therefore the maximum outer diameter setting for the device 1. In the illustrated embodiment the locking member 24 is a ring threadingly engaged to the sleeve 21 to engage the collar 22 to fix the axial position of the collar 22 on the sleeve 21. In FIG. 3, the locking ring is shown separated from the collar. To lock the position of the collar on the sleeve, the ring 24 is threaded along the sleeve until it engages against the collar, as shown in FIGS. 2A to 2D. Other locking members/arrangements are possible, such as a radial pin received through aligned holes in the collar and sleeve, with a series of pin holes spaced apart along the sleeve to provide for different diameter settings.

In the illustrated embodiment, an adjustment mechanism is provided at each support 7, 8. In such an example, the threaded engagement at the first or second support 7, 8 may be a right-hand thread and the threaded engagement at the other one of the first and second support may be a left-hand thread, so that adjustment of the maximum outer diameter may be made by rotating the arm assemblies 3 about the mandrel or tool/longitudinal axis 4 of the centraliser. The collar 22 at each support 7, 8, rotates on the threaded engagement relative to the sleeve 21 together with the arm assemblies 3. The sleeves 21 may remain rotationally fixed to the mandrel 10. Once the maximum outer diameter is set, the set position of the collars 22 on the respective sleeves 21 may be locked by the locking member 24 at one or both supports 7, 8. The sleeves 21 may be keyed to the mandrel 10 to prevent relative rotation therebetween. For example, in FIG. 4, the mandrel 10*a* comprises a facetted outer surface engaging a corresponding faceted surface of the sleeves 21*a* to rotationally key the sleeve to the mandrel. The centraliser 1*a* of FIG. 4 is otherwise the same as the centraliser 1 of FIGS. 2A to 2H.

FIGS. 5A to 5I illustrate a further example centraliser 201 comprising an arm support assembly with an adjustment mechanism configured to set a maximum outer diameter of the device. Same or similar parts/features already described above with reference to FIG. 2A to 2H or parts that perform the same or similar function may be identified in FIGS. 5A to 5I by the same reference numerals appearing above but with an added prefix of "2" or "20". Same or similar parts may not be described again for brevity.

The centraliser 201 is configured as a slip over device to fit on the outside of a wireline logging tool. The centraliser 201 comprises six arm assemblies 203 azimuthally spaced apart around the centraliser. The arm assemblies 203 each comprise an arm 205 extending circumferentially around the longitudinal axis so that the first pivot joint 211 and the second pivot joint 212 are on opposite sides of a plane coincident with the longitudinal axis, as described in U.S. Pat. No. 10,947,791. FIG. 5I best illustrates the relative radial positions of the pivot axes 211*a*, 212*a*, 213*a* of the first, second and third pivot joints 211, 212, 213 of an arm assembly 203. As described earlier, the arm assemblies are energised by leaf springs 209. The particular arm arrangement is provided by way of example only, the device may include alternative arm assemblies, such as arm assemblies 3 as shown in the earlier example embodiment 1.

In the illustrated example, only one of the two supports 207, 208 comprises an adjustment mechanism. The support 207 comprising an adjustment mechanism comprises a sleeve 221 and a collar 222 mounted to the sleeve by a threaded engagement, the sleeve and collar providing the adjustment mechanism. The sleeve 221 is configured to slide axially along the longitudinal axis 4 of the device. The threaded engagement provides relative axial movement between the collar 222 and sleeve 221 to adjust an axial position of the respective pivot joint 211 of the arm assemblies 203 along the longitudinal axis 4 to correspondingly set the maximum outside diameter of the device 201.

Axial travel of the support 207 is limited by a mechanical stop 215, to define the outer diameter of the device 201. In contrast to the earlier embodiment 1, the arm assemblies 203 are pivotally connected to the sleeve 221, and the collar 222 bears against the mechanical stop 215 to define the maximum axial travel of the support 207 along the longitudinal axis 4. The relative axial movement of the collar 222 on the sleeve 221 provided for by the threaded engagement 223 adjusts the axial position of the sleeve 221 and the respective pivot joints 211 of the arm assemblies 203 relative to the mechanical stop 215 to correspondingly set the maximum outside diameter of the device 201 within the desired diameter range. The adjustment mechanism therefore provides for an adjustable mechanical stop relative to the arm assemblies.

Figure 6:
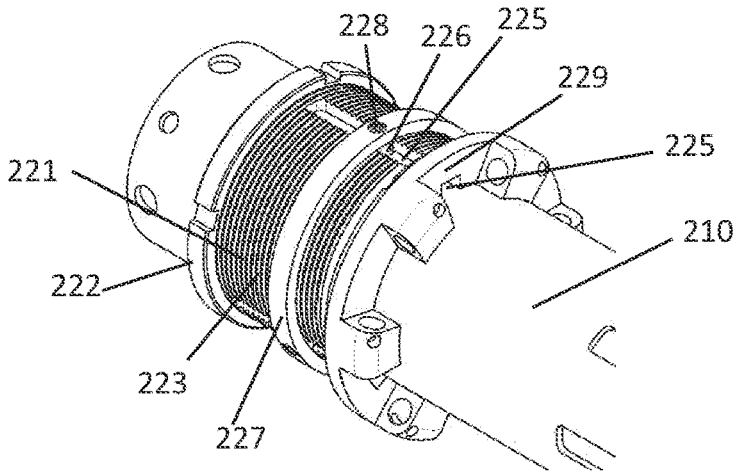
FIG. 6 shows a sliding support assembly and portion of a mandrel from the centraliser of FIGS. 5A to 5I, with a locking member omitted.
Figure 7:
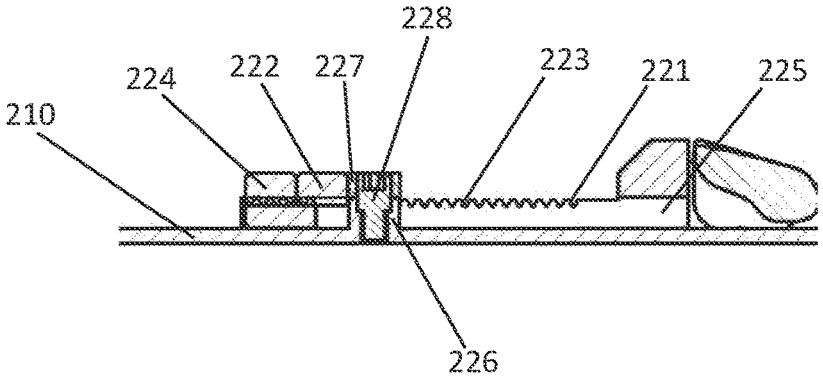
FIG. 7 is a section view on a section plane through a longitudinal centre of the device of FIG. 5A to 5I showing a port of a sliding support assembly of the device illustrated components of an adjustment mechanism.

In the illustrated embodiment, and with reference to FIGS. 6 and 7, the sleeve 221 comprises axial slots 225 to receive the mechanical stop 215 therethrough to bear against the collar 222. The axial slots are spaced circumferentially apart around a central axis of the device. The mechanical stop 215 comprises a plurality of projections or pins (herein projections) 226 extending from the mandrel 210. The projections 226 are received in the slots 225 in the sleeve 221. The projections may be integrally formed with the mandrel.

In the illustrated embodiment, the mechanical stop 215 further comprises a ring 227 attached to the projections 226, e.g. by fasteners 228. The axial slots extend fully through the sleeve in a radial direction, i.e. from an internal diameter of the sleeve to an outside diameter of the sleeve. The projections extend through the slots and the ring is attached to the projections on the outside of the sleeve to extend around an outside of the sleeve 221 such that the sleeve may slide relative to the ring 227 (and mandrel 210). The collar 222 engaged with the sleeve 221 via the threaded engagement bears against the ring 227 (as shown in FIG. 7) to define the maximum axial travel of the support 207. Alternatively, the ring 227 may be attached to the mandrel 210 via fasteners 228 extending through the slots 225 to engage the mandrel 210, the fasteners forming the projections extending from the mandrel. In a further alternative, the projections may bear against an axially outer closed end of the slots to set the maximum OD of the device, i.e. the stop arrangement may be without a ring attached to the projections.

The illustrated embodiment comprises three axial slots and three corresponding projections received in the slots. However, one skilled in the art will appreciate one, two, three or more slots and corresponding projections may be provided. For example, in a further alternative arrangement, the sleeve may comprise one slot 225 and the stop 215 a corresponding projection 226, 228. The projection(s) 226, 228 may bear directly against the collar 222, i.e. the mechanical stop 215 may be without ring 227.

The axial slots 225 may be open through an end of the sleeve as shown in FIG. 6, to allow the sleeve to receive the pins/projections 226 into the slots when assembling the sleeve 221 to the mandrel 210. The slots are open through an axially inner end of the sleeve so that the sleeve can be assembled to the mandrel from one end of the mandrel to pass over the projections. The sleeve 221 may comprise a bridge 229 extending over the slot 225 at the open end of the slot.

The adjustment mechanism comprises a locking member 224 to lock the position of the adjustment mechanism and therefor the maximum outer diameter setting. Like in the earlier embodiment, the locking member is a ring 224 threadingly engaged to the sleeve 221 to engage the collar 222 to fix the axial position of the collar 222 on the sleeve 221. Other locking members/arrangements are possible, such as a radial pin received through aligned holes in the collar and sleeve, with a series of pin holes spaced apart along the sleeve to provide for different diameter settings.

While the embodiment of FIGS. 5A to 5I has an adjustment mechanism at one of the two supports, one skilled in the art will appreciate both supports 207, 208 may include the described adjustment mechanism. In FIGS. 5A to 5I, the support 208 without an adjustment mechanism is a sliding support. A mechanical stop 216 is provided to limit the axial movement of the support 208 towards the other support 207 to thereby limit the maximum outer diameter of the device adjustable at the other support 207. One skilled in the art will understand the support 208 may be fixed to not slide along the mandrel 210. Further, a centraliser may comprise a first support with an adjustment mechanism as described with reference to FIGS. 2A to 2H, and a second support with an adjustment mechanism as described with reference to FIGS. 5A to 5I.

The mechanical stop arrangement 215 described with reference to FIGS. 5A to 7 may be employed in a centraliser device that is without an adjustment mechanism for setting the maximum outer diameter of the device. Such a device may comprise a support with a sleeve 221 with one or more slots 225 as described. One or more projections 226 received in the one or more slots and fixed to and/or extending from the mandrel may engage the sleeve to define a fixed maximum outer diameter of the device. For example, the projection(s) 226 may engage an (axially outer) end of the slot(s) 225 to define the maximum OD of the device, or may bear against a shoulder formed on the outer side of the sleeve, for example, a collar 222 may be attached to or integrally formed with the sleeve 221 to engage mandrel projections 226 extending through the slots or a ring 227 fixed to the pins.

Figure 8:
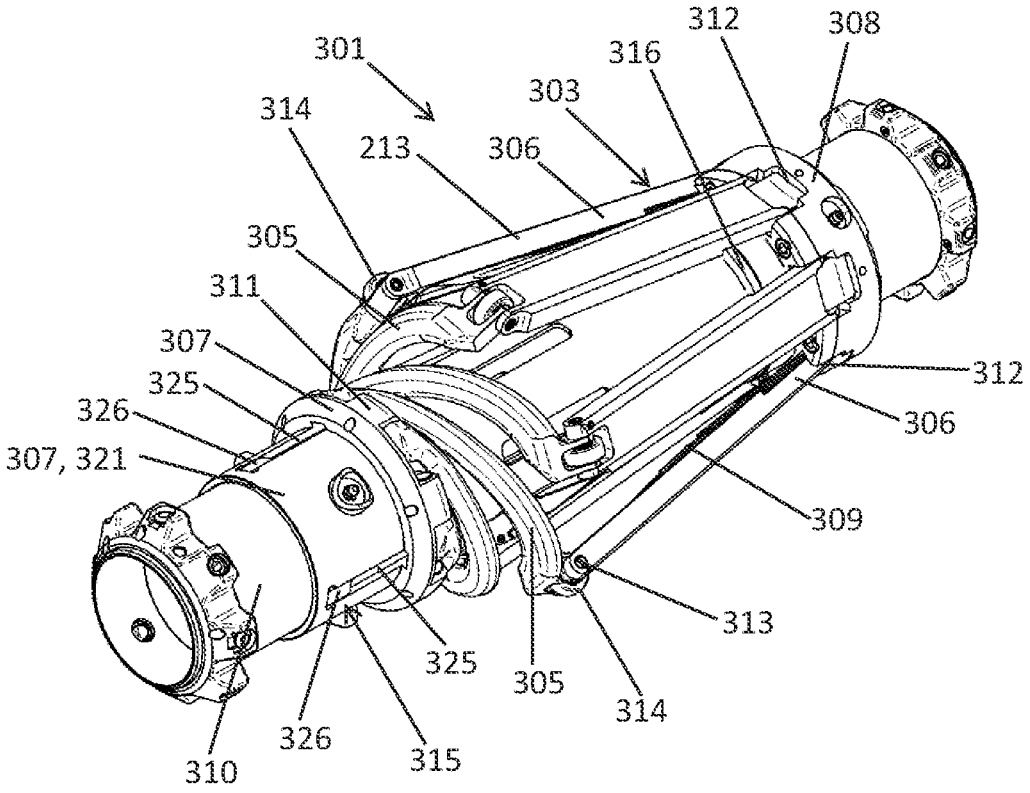
FIG. 8 is an isometric view of a centraliser according to another embodiment of the present invention with arm assemblies of the centraliser in a radially outward position at a maximum OD of the centraliser.

FIG. 8 illustrates an example of such a device 301 with a mechanical stop arrangement 315 and without an adjustment mechanism for setting the maximum outer diameter of the device. The same or similar parts/features already described above are identified in FIG. 8 by the same reference numerals appearing in FIGS. 5A to 7 but with the prefix "2" or "20" replaced with prefix "3" or "30" and are not described again for brevity. In FIG. 8, the sliding support 307 is without an adjustment mechanism for setting the OD of the device.

In FIG. 8, the device 301 is illustrated with the mandrel projections 326 engaged with closed ends of the slots 325 in the sliding sleeve 321 to limit the axial travel of the sliding support 207 and thereby define the fixed maximum outer diameter of the device. The other sliding support 308 is shown engaging the stop 316 on the mandrel 310, with the device therefore illustrated at its maximum OD configuration. With the projections 326 configured to engage the ends of the slots 325 the stop arrangement 315 does not include a ring attached to the projections 326 as described in the earlier embodiment (e.g. ring 227 in FIG. 7). The sliding sleeve 321 is also without a thread on its outer surface (e.g. thread 223 FIG. 7) since no adjustment mechanism is provided. The slots 325 are open at an axially inward end like the slots 225 shown in FIG. 7 to allow the support 307 to be assembled to the mandrel over the projections 326. The axial slots 326 are positioned circumferentially in between the pivots 311 at the support member 307. In the embodiment of FIG. 8, the projections 326 are rectangular and act as keys, with the slots 325 acting as keyways, to rotationally key the support 307 to the mandrel 310. Thus, the projections 326 provide two functions, to both key the support 307 to the mandrel and additionally provide a mechanical stop 315 to set the maximum OD of the device. A centraliser according to one or more aspects of the present invention as described above provides one or more of the following benefits. The maximum outer diameter of the device may be adjusted within a range of maximum outer diameters, between a smallest maximum outer diameter and a largest maximum outer diameter. This allows the maximum outer diameter to be set to correspond with a known bore diameter, which can make the device easier to insert into a bore or move from a larger diameter bore where centralisation is not required into a smaller diameter bore. The maximum outer diameter may be set to be equal to or slightly less than a known bore diameter to reduce rolling friction between the centraliser and bore wall as the centraliser traverses the bore. The stop arrangement described with reference to FIGS. 5A to 8 positions the mechanical stop 215 axially away from the pivot joint 211 at the support 207 which frees up annual space for incorporating the pivot joints at the support which is a significant benefit since annular space is limited. Annual space to accommodate a mechanical stop is particularly limited where the arm pivot at the sliding support is on the opposite side of the device to the arm assembly wheel, as the arm must extend from the sliding support around the central mandrel of the device, taking up space where a stop on the mandrel would typically be positioned. Placing the arm pivot on the opposite side of the device to the arm assembly wheel increases the arm angle and ensures sufficient axial movement of the support to ensure efficient mechanics and a more constant centering force over a range of bore diameters. The mechanical stop arrangement also achieves rotational keying of the sleeve to the mandrel via the pins/projections received through the slots to prevent relative rotation between the sleeve and mandrel, thus improving efficient use of space. Furthermore, the centralisers described herein are passive devices, with energisation being provided by mechanical spring components only. No other power input, such as electrical or hydraulic power provided from service located power units is required. The invention therefore may provide a lower cost, effective, and simplified device that provides improved operational reliability.

The invention has been described with reference to centering a tool string in a wellbore during a wireline logging operation. However, a centralising device according to the present invention may be used for centering a sensor assembly in a bore in other applications, for example to center a camera in a pipe for inspection purposes.

Although this invention has been described by way of example and with reference to possible embodiments thereof, it is to be understood that modifications or improvements may be made thereto without departing from the spirit or scope of the appended claims.

The invention claimed is:

1. A device for centering a sensor assembly in a bore, the device comprising:

a first support and a second support axially spaced apart along a central longitudinal axis of the device, wherein one or both of the first and second supports is a sliding support configured to slide axially along the central longitudinal axis, and a plurality of arm assemblies pivotally connected between the first and second supports, each arm assembly pivotally connected to the first and second supports by a respective pivot joint, and a mechanical stop providing a limit of axial travel for the sliding support to thereby define a maximum outer diameter of the device, wherein the sliding support comprises a sleeve with one or more axial slots, the sleeve configured to slide along the central longitudinal axis, and the mechanical stop comprises one or more projections extending from a central mandrel of the device, the one or more projections corresponding with the one or more slots, each projection received in a said slot, wherein each of the one or more projections bears against the sliding support to provide the limit of axial travel.

2. The device as claimed in claim 1, wherein the sleeve comprises a plurality of said axial slots and the mechanical stop comprises a plurality of said projections received in the slots, the plurality of axial slots and the plurality of projections spaced circumferentially apart around the central longitudinal axis.

3. The device as claimed in claim 1, wherein the one or more projections bear against the sleeve to provide the limit of axial travel.

4. The device as claimed in claim 1, wherein each of the one or more projections bears against a closed end of the corresponding said axial slot to provide the limit of axial travel.

5. The device as claimed in claim 1, wherein the mechanical stop comprises a ring attached to radial ends the projections, the projections extending through the slots and the ring extending around an outside diameter of the sleeve to allow the sleeve to slide relative to the ring, and the rings bears against the sliding support to provide the limit of axial travel.

6. The device as claimed in claim 5, wherein the sleeve bears against the ring to provide the limit of axial travel.

7. The device as claimed in claim 5, wherein the sliding support comprises an adjustment mechanism configured to set a maximum outer diameter of the device, and wherein sliding support comprises a collar mounted to the sleeve by a threaded engagement, the collar bears against the ring to provide the limit of axial travel, the sleeve and collar with threaded engagement thereby providing the adjustment mechanism.

8. The device as claimed in claim 1, wherein the sliding support comprises an adjustment mechanism configured to set a maximum outer diameter of the device, and wherein sliding support comprises a collar mounted to the sleeve by a threaded engagement, the collar bears against the mechanical stop to provide the limit of axial travel, the sleeve and collar with threaded engagement thereby providing the adjustment mechanism.

9. The device as claimed in claim 8 wherein the adjustment mechanism comprises a locking member to lock the position of the adjustment mechanism and therefore the maximum outer diameter setting.

10. The device as claimed in claim 9, wherein the locking member is a threaded ring mounted to the sleeve to engage the collar by relative rotation provided for by the threaded engagement.

11. A device for centering a sensor assembly in a bore, the device comprising:

a first support and a second support axially spaced apart along a central longitudinal axis of the device, one or both of the first and second supports configured to slide axially along the central longitudinal axis, and a plurality of arm assemblies pivotally connected between the first and second supports, each arm assembly pivotally connected to the first and second supports by a respective pivot joint, wherein one or both supports comprise a sleeve and a collar mounted to the sleeve by a threaded engagement, the arm assemblies pivotally connected to the sleeve or collar, the sleeve and collar with threaded engagement providing an adjustment mechanism configured to set a maximum outer diameter of the device, and the adjustment mechanism comprises a locking member to lock the position of the adjustment mechanism and therefore the maximum outer diameter setting, wherein the locking member is a threaded ring mounted to the sleeve to engage the collar by relative rotation provided for by the threaded engagement.

12. The device as claimed in claim 11, wherein:

the sleeve is configured to slide axially along the central longitudinal axis, and the collar is mounted to the sleeve by the threaded engagement to provide relative axial movement therebetween to adjust an axial position of the respective pivot joints of the arm assemblies along the longitudinal axis to correspondingly set the maximum outside diameter of the device.

13. The device as claimed in claim 12, wherein:

the support bears against a mechanical stop to define an axial travel limit for the sleeve along the longitudinal axis and a corresponding maximum outward radial movement of the arm assemblies, and relative axial movement of the collar on the sleeve adjusts the axial position of the respective pivot joints of the arm assemblies relative to the mechanical stop to correspondingly set the maximum outside diameter of the device.

14. The device as claimed in claim 13, wherein:

the arm assemblies are pivotally connected to the collar, and the sleeve bears against the mechanical stop to define a maximum axial travel of the support along the longitudinal axis, wherein relative axial movement of the collar on the sleeve adjusts the axial position of the collar and the respective pivot joints of the arm assemblies relative to the mechanical stop to correspondingly set the maximum outside diameter of the device.

15. The device as claimed in claim 14, wherein the first and second supports each comprise a said adjustment mechanism, and wherein the threaded engagement of the adjustment mechanism of the first or second support comprises a right-hand thread, and the threaded engagement of the adjustment mechanisms of the other one of the first and second supports comprises a left-hand thread, so that adjustment of the maximum outer diameter is made by rotating the arm assemblies relative to the sleeves of the first and second supports about the longitudinal axis.

16. The device as claimed in claim 13, wherein:

the arm assemblies are pivotally connected to the sleeve, and the collar bears against the mechanical stop to define the axial travel limit for the sleeve along the longitudinal axis, wherein relative axial movement of the collar on the sleeve adjusts the axial position of the sleeve and the respective pivot joints of the arm assemblies relative to the mechanical stop to correspondingly set the maximum outside diameter of the device.

17. The device as claimed in claim 16, wherein the sleeve comprises one or more axial slots to receive the mechanical stop to bear against the collar to provide the limit of axial travel.

18. The device as claimed in claim 17, wherein the mechanical stop comprises one or more projections extending from a central mandrel of the device, the one or more projections corresponding with the one or more slots, each projection received in a said slot.

19. The device as claimed in claim 18, wherein the sleeve comprises a plurality of said axial slots and the mechanical stop comprises a plurality of said projections received in the slots.

20. The device as claimed in claim 19, wherein the mechanical stop comprises a ring attached to the projections, the collar bearing against the ring to provide the limit of axial travel.

21. A device for centering a sensor assembly in a bore, the device comprising:

a first support and a second support axially spaced apart along a central longitudinal axis of the device, one or both of the first and second supports configured to slide axially along the central longitudinal axis, and a plurality of arm assemblies pivotally connected between the first and second supports, each arm assembly pivotally connected to the first and second supports by a respective pivot joint, wherein, the first and second supports each comprise a sleeve and a collar mounted to the sleeve by a threaded engagement, the sleeve and collar with threaded engagement providing an adjustment mechanism configured to set a maximum outer diameter of the device, and the arm assemblies are pivotally connected to the collar, and the sleeve bears against a mechanical stop to define a maximum axial travel of the support along the longitudinal axis, wherein relative axial movement of the collar on the sleeve adjusts the axial position of the collar and the respective pivot joints of the arm assemblies relative to the mechanical stop to correspondingly set the maximum outside diameter of the device, and wherein the threaded engagement of the adjustment mechanism of the first or second support comprises a right-hand thread, and the threaded engagement of the adjustment mechanisms of the other one of the first and second supports comprises a left-hand thread, so that adjustment of the maximum outer diameter is made by rotating the arm assemblies relative to the sleeves of the first and second supports about the longitudinal axis.

* * * * *